United States Patent [19]

Spamer et al.

[11] Patent Number: 5,016,527

[45] Date of Patent: May 21, 1991

[54] PRODUCT DISPLAY ENCLOSURE

[75] Inventors: William S. Spamer, Roswell; J. David Robertson; David C. F. Stoddard, both of Atlanta; James L. Hanna, Athens, all of Ga.

[73] Assignee: The Mead Corporation, Dayton, Ohio

[21] Appl. No.: 508,002

[22] Filed: Apr. 10, 1990

[51] Int. Cl.[5] ..... E04H 15/14; F25D 1/00

[52] U.S. Cl. ..... 98/115.3; 34/102

[58] Field of Search ..... 98/115.3; 312/100, 102, 312/116; 34/93

[56] References Cited

U.S. PATENT DOCUMENTS

| | | | |
|---|---|---|---|
| 238,307 | 3/1881 | Pecor | 312/116 |
| 694,987 | 3/1902 | Pollard | 312/100 |
| 1,556,865 | 10/1925 | Müller | 34/93 |
| 3,505,945 | 6/1968 | Greer | 98/115.3 |
| 3,943,726 | 3/1976 | Miller | 98/2.11 |
| 4,202,676 | 3/1980 | Pelosi, Jr. et al. | 98/115.3 |
| 4,221,059 | 9/1980 | Everitt | 34/93 |
| 4,310,044 | 1/1982 | Schenker | 312/116 |
| 4,392,360 | 1/1983 | Gidge et al. | 312/116 |
| 4,429,548 | 2/1984 | Layne | 312/116 |
| 4,441,766 | 4/1984 | Hess | 312/100 |

*Primary Examiner*—Albert J. Makay
*Assistant Examiner*—W. Doerrler
*Attorney, Agent, or Firm*—Rodgers & Rodgers

[57] ABSTRACT

For an outdoor display of items for sale and for protecting such items against environmental elements such as dust, dirt, moisture, sunlight and temperature variations and the like, a lightweight box-like structure is formed of radiation reflecting material and is provided with venting apertures and includes manually movable transparent closure means formed in at least one side wall of the enclosing structure for affording ready visibility and access to items disposed within the enclosure.

5 Claims, 5 Drawing Sheets

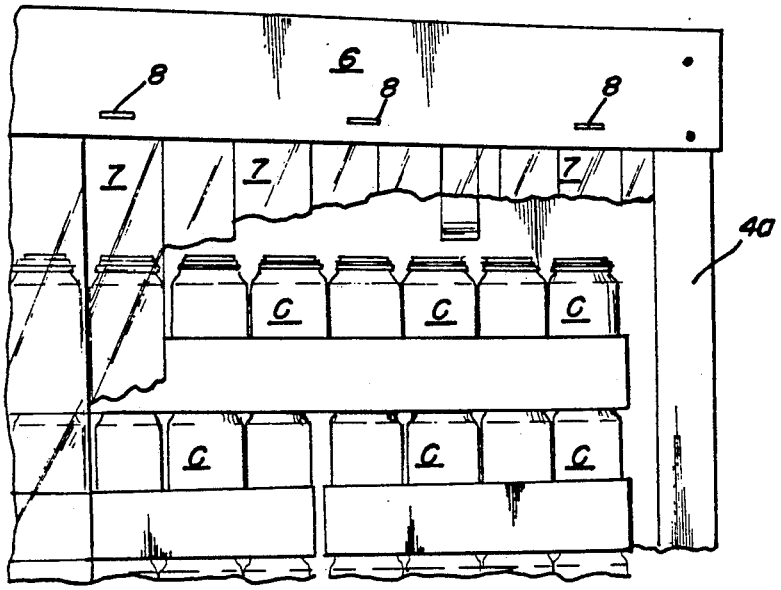
FIG. 9
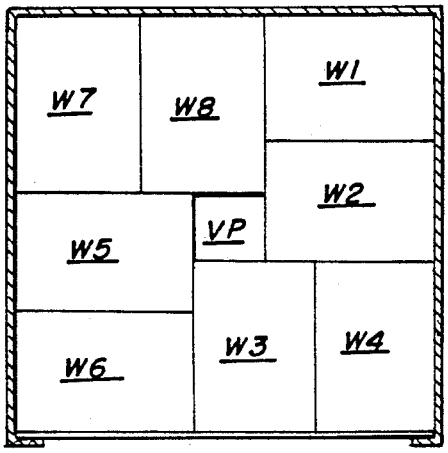
FIG. 10
FIG. 11
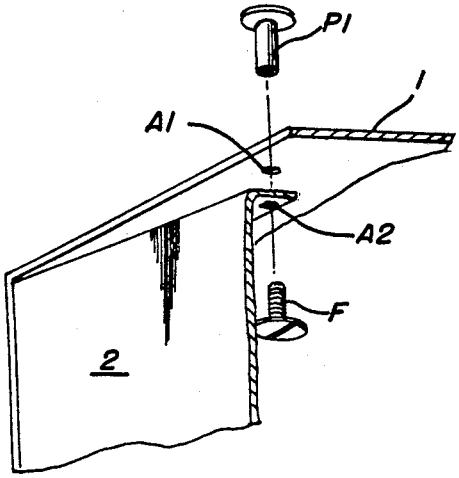

PRODUCT DISPLAY ENCLOSURE

TECHNICAL FIELD

This invention pertains primarily to outdoor point of sale of displayed items and for protecting such items from environmental hazards.

BACKGROUND ART

For displaying point of purchase items such as soft drinks and the like in an outdoor display, known past practices have involved the use of tents, sheds and the like which ordinarily have not been well conceived or well executed.

SUMMARY

According to this invention in one form, a stack of items for outdoor sale is protected by an enclosure comprising front, back and side walls interconnected along their side edges and having a top cover joined along its edges to the top edges of the front, back and side walls to form a box-like structure adapted to overlie and surround the stack of items so as to afford protection of such items against undesirable environmental conditions including dust, dirt, moisture, sunlight, temperature variations and the like, at least one of the walls of the enclosure being constructed to afford full view and ready access to such items. In one form of the invention, advantage is taken of convection principles for maintaining internal temperature conditions within the enclosure at acceptable levels. In accordance with other forms of the invention, air circulation may be provided by forced feed means such as electrically powered fans and if desired the atmosphere within the enclosure could take the form of heat dissipating gases such as carbon dioxide and the like which are injected into the enclosure.

BRIEF DESCRIPTION OF THE DRAWINGS

In the drawings,

FIG. 9 is a fragmentary front view of one corner of the enclosure and showing a portion of a pallet stack of items displayed within the enclosure;

FIG. 10 is a cross sectional view taken along the line designated 10—10 in FIG. 1;

FIG. 11 is an enlarged fragmentary exploded view showing the manner in which the cover is secured by suitable bolt or pin means to a side wall;

BEST MODE OF CARRYING OUT THE INVENTION

Figure 1:
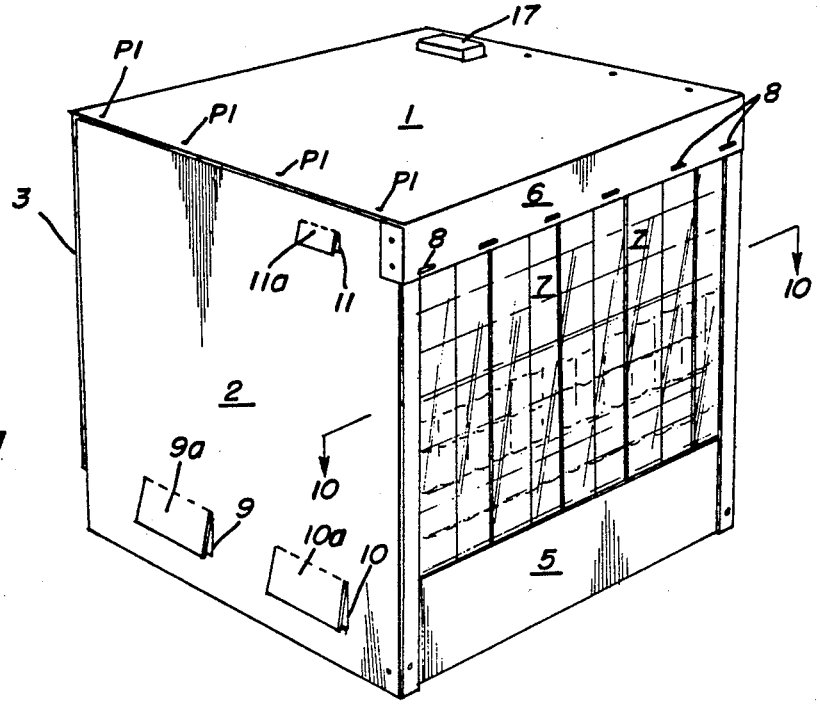
FIG. 1 is a perspective overall view of an enclosure formed according to this invention as seen from the front and from one side.
Figure 2:
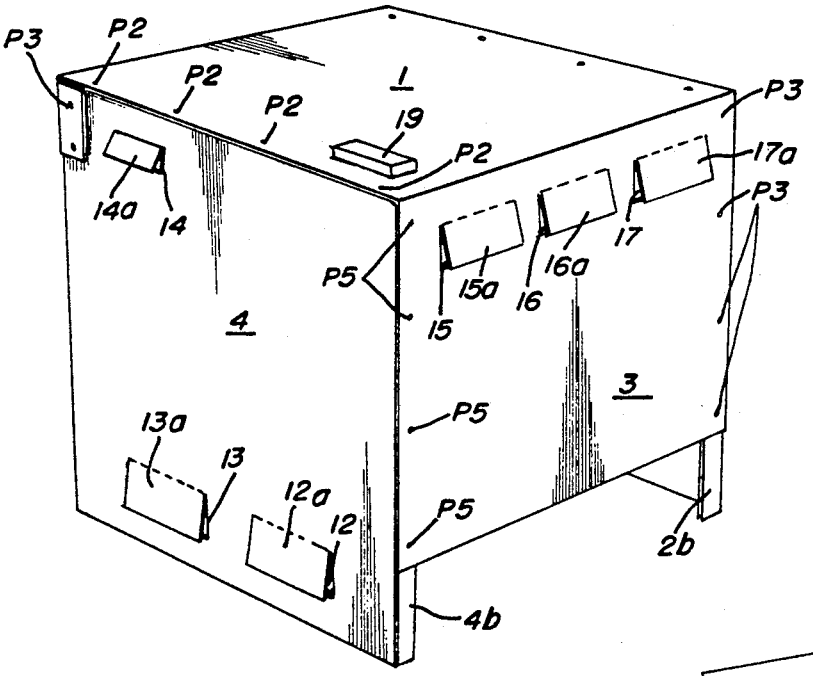
FIG. 2 is a view similar to FIG. 1 and shows the structure as viewed from its rear wall and from another side.

In FIGS. 1 and 2, the numeral 1 designates the cover of the enclosure while the numeral 2 designates a side wall and the numeral 3 designates the back wall. Another side wall is designated by the numeral 4. The front wall of the enclosure includes a lower transverse closure panel 5 and an upper horizontal cross piece 6 from which manually movable transparent closure means is suspended as shown in FIGS. 1 and 9. The manually movable transparent closure means comprises a plurality of transparent plastic strips secured at their upper ends by staples 8 to horizontal cross pieces 6 and **6*a* and arranged with their lower ends disposed inside the transverse closure panel 5. Instead of the transparent closure strips 7**, other manually movable transparent means could be employed within the purview of this invention such for example as a transparent pull down shade.

While this invention is not limited to any particular materials, it has been found that desirable results are obtained using plastic corrugated sheet similar to that sold under the trademark "Coroplast" and marketed by Coroplast, Inc. for use in forming the cover, side and back walls and the upper and lower transverse panels used in forming the front wall of an enclosure formed according to this invention.

Preferably the walls and cover should be light in color and in most cases should be white so as to facilitate reflection of light. Experience has shown that significant protection is afforded against ultra violet radiation and the attendant degradation of photodegradable compounds such as ink and in this manner substantial extension of product life is achieved. Also the strips 7 may be formed of vinyl material and aid in protection against ultraviolet radiation.

The enclosure formed according to this invention is suitably vented to facilitate circulation of air. Vents 9, 10 and 11 are formed in side wall 2 and are provided respectively with movable closure panels **9*a*, 10*a* and 11*a***.

The opposite side wall 4 is provided with vents 12, 13 and 14 which are respectively provided with movable closure panels 12*a*, 13*a* and 14*a*.

The vents 11 and 14 are formed near the top of their associated side walls and are located near the front of the enclosure because the cover 1 is slanted downwardly from front to back so that accumulation of heated air tends to develop near the high point of the enclosure in the area adjacent the vents 11 and 14. Exhaust of such heated air is thus facilitated.

In the back wall 3, a plurality of vents 15, 16, and 17 are provided and respectively include vent closure panels 15*a*, 16*a* and 17*a*. The total area of vents 9–17 is between 2 percent and 8 percent of the total surface area of the walls and cover excluding the area of the manually movable transparent closure means.

Figure 3:
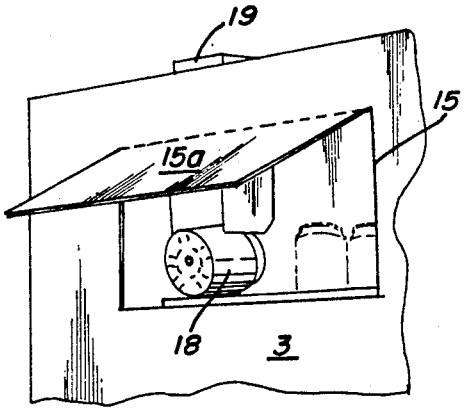
FIG. 3 is a fragmentary enlarged perspective view of a corner of the structure such as is shown in FIG. 2 with a vent aperture disposed in front of a motor driven electric fan for circulating air within the enclosure.

For facilitating the flow of air through the enclosure, and as best shown in FIG. 3, an electric motor 18 may be provided to drive a fan so that air within the enclosure is forced outwardly through the vent 15. Energy for driving the motor 18 may be derived from a battery or from the solar panel 19 which converts radiation from the sun into electricity and which is automatically renewed on a continuous basis. While the motor 18 and associated fan are useful for some applications of the invention, there are many situations which function well without employing a motor and fan or any other air circulating device.

Figure 4:
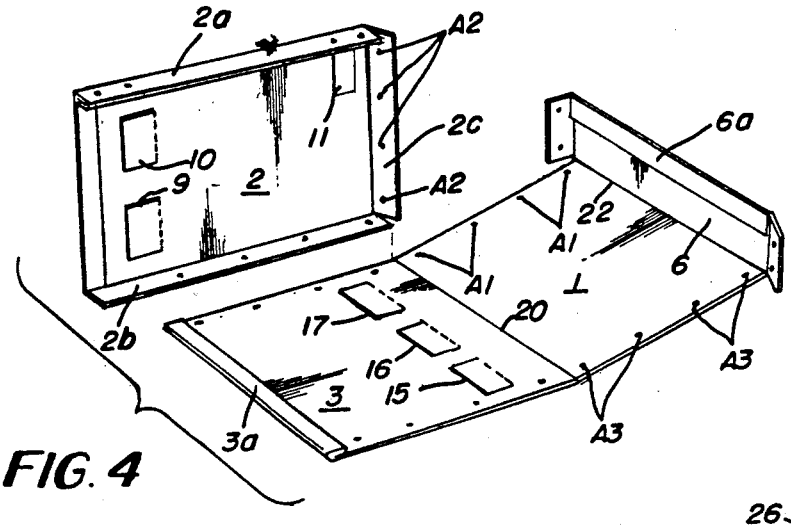
FIG. 4 is a perspective exploded view showing the cover and rear wall in collapsed condition together with one side wall.
Figure 7:
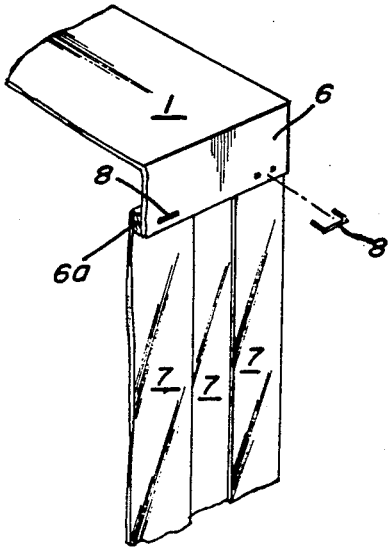
FIG. 7 is a fragmentary enlarged view of a portion of the cover together with portions of movable transparent strips forming a portion of the front wall.
Figure 5:
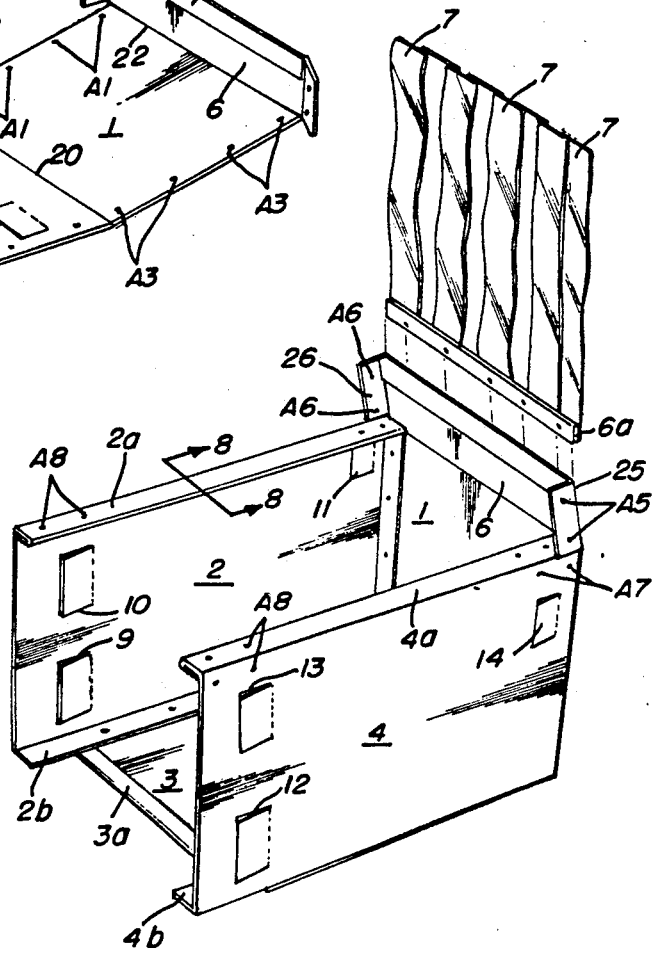
FIG. 5 is a view of the side and rear walls and of the cover in assembled condition and with a moveable portion of the front wall disposed in exploded condition.

As shown in the exploded view designated FIG. 4, the back wall 3 is foldably joined along fold line 20 to cover 1. Transverse cross piece 6 is foldably joined along fold line 22 to cover 1 and cross piece 6*a* is secured to the inner surface of transverse cross piece 6 as shown in FIG. 5. As shown in FIGS. 1 and 7, the flexible transparent strips 7 are secured to horizontal cross pieces 6 and 6*a* by staples 8.

Figure 6:
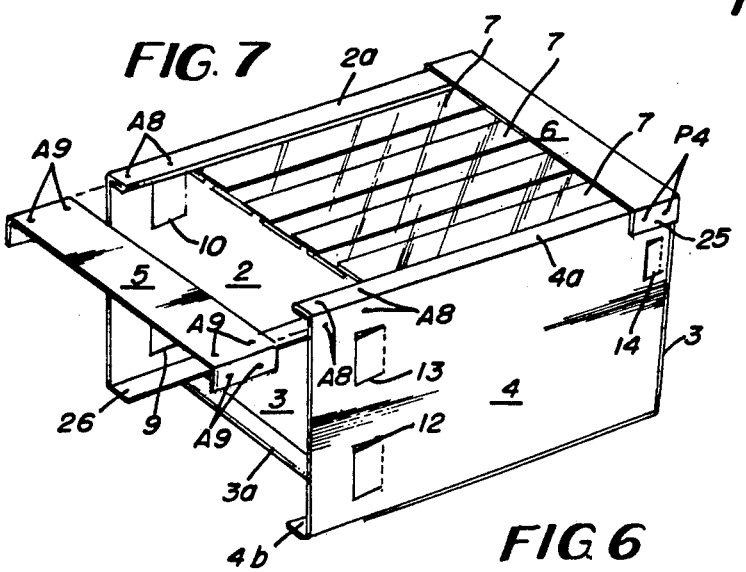
FIG. 6 is a view similar to FIG. 5 but which shows the movable portion of the front wall in assembled condition and a lower transverse closure panel exploded from its normal position at the bottom of the front wall.

FIG. 6 is similar to FIG. 5 but shows the enclosure fully assembled except that the lower closure panel 5 is shown as exploded from its fully assembled position.

Figure 8:
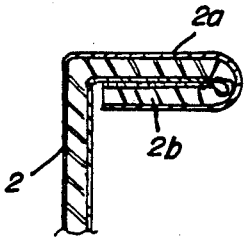
FIG. 8 is an enlarged fragmentary cross sectional view taken along the line designated 8—8 in FIG. 5.

FIG. 8 discloses in cross sectional form the folded front edge 2*a* of side wall 2. The doubled back portion 2*b* is secured in flat relation with the inner surface of turned back edge portion 2*a* by means of a strip of double face tape interposed between elements 2*a* and 2*b* thus to establish a strong corner post of substantial rigidity. In like fashion, the front portion 4*a* of side wall 4 is folded into normal relation with respect to side wall 4 and is reinforced in the manner indicated above in connection with side wall 2.

The cover 1 is secured to the top edge of side wall 2 by a plurality of pins Pl which are inserted into apertures A1 formed in a side edge of cover 1 and into apertures A2 formed in the folded top edge of 2*c* of side wall 2.

In like fashion, the cover 1 is secured to the top edge of side wall 4 along an edge by pins P2 which are inserted through apertures A3 and into corresponding apertures formed in the folded top edge of side wall 4.

Similarly, pins P4 are inserted into apertures A5 formed in turned down panel 25 foldably joined to one end of horizontal cross piece 6 and into apertures A7 formed in side wall 4. Cross piece 26 is similarly secured to an upper corner of side wall 2 by pins inserted into apertures A6.

From FIGS. 5 and 6, it is clear that the flexible transparent strips 7 are disposed in overlapping relation with each other so as to form an effective manually movable transparent means in the front wall. If desired, similar means could be formed in one or more other walls if need be. Also the strips 7 may be arranged with their edges simply in parallel closely spaced relation not necessarily overlapped.

The transverse closure panel 5 is secured to the bottom portion of side walls 2 and 4 by suitable pins inserted apertures A8 and A9 as is obvious from FIG. 6.

Back panel 3 is secured to folded panel 2*b* by pins P3 and to turned back panel 4*b* by pins P5 as shown in FIG. 2.

For reinforcing the bottom edge of back wall 3, the lower portion 3*a* is folded back on the lower edge of back wall 3 as is a particularly in FIGS. 4, 5 and 6.

FIG. 11 simply shows cover 1 and side wall 2 with pin P1 and F for securing cover 1 to side wall 2. Obviously securing means may be used if desired.

The enlarged fragmentary view designated FIG. 9 shows the strips 7 broken away and behind which are disposed a pallet stack of consumer items such as soft drinks identified at C. While the displayed items may or may not be mounted on a pallet, it is vital that items within the enclosure be arranged and the vents located so as not to interfere with circulation.

In order to ventilate an enclosure formed according to this invention, the clearance between the inside walls of the enclosure and the outside surface of the pallet stack should range between one-half inch and four inches and preferably should be approximately one and one-half inches. Not only should there be proper clearance between the outer surfaces of a pallet stack and the inner surface of the enclosure walls, it is very desirable to arrange the displayed items in such fashion that a ventilating passage is formed. In FIG. 10, this passage is designated at VP. Also in FIG. 10, groups of packaged items such as cans may be arranged in wrappers such as are designated W1–W8. These particular wrappers are arranged so that they have a greater length than width. For example, each may comprise three rows of four cans each. Thus the arrangement indicated in FIG. 10 is feasible and desirable.

Since the enclosure formed according to this invention is a light weight structure, it is feasible to stack the product to be displayed in the open and then to lower the assembled enclosure which has no bottom wall over the product stack. This procedure is simpler and less time consuming and facilitates stack rotation as distinguished from stacking the product inside an enclosure.

While not shown in the drawings, it is desirable to form holes in the walls or to mount hooks in an appropriate manner to cooperate with suitable rope in order to tie the enclosure in place.

Figure 12:
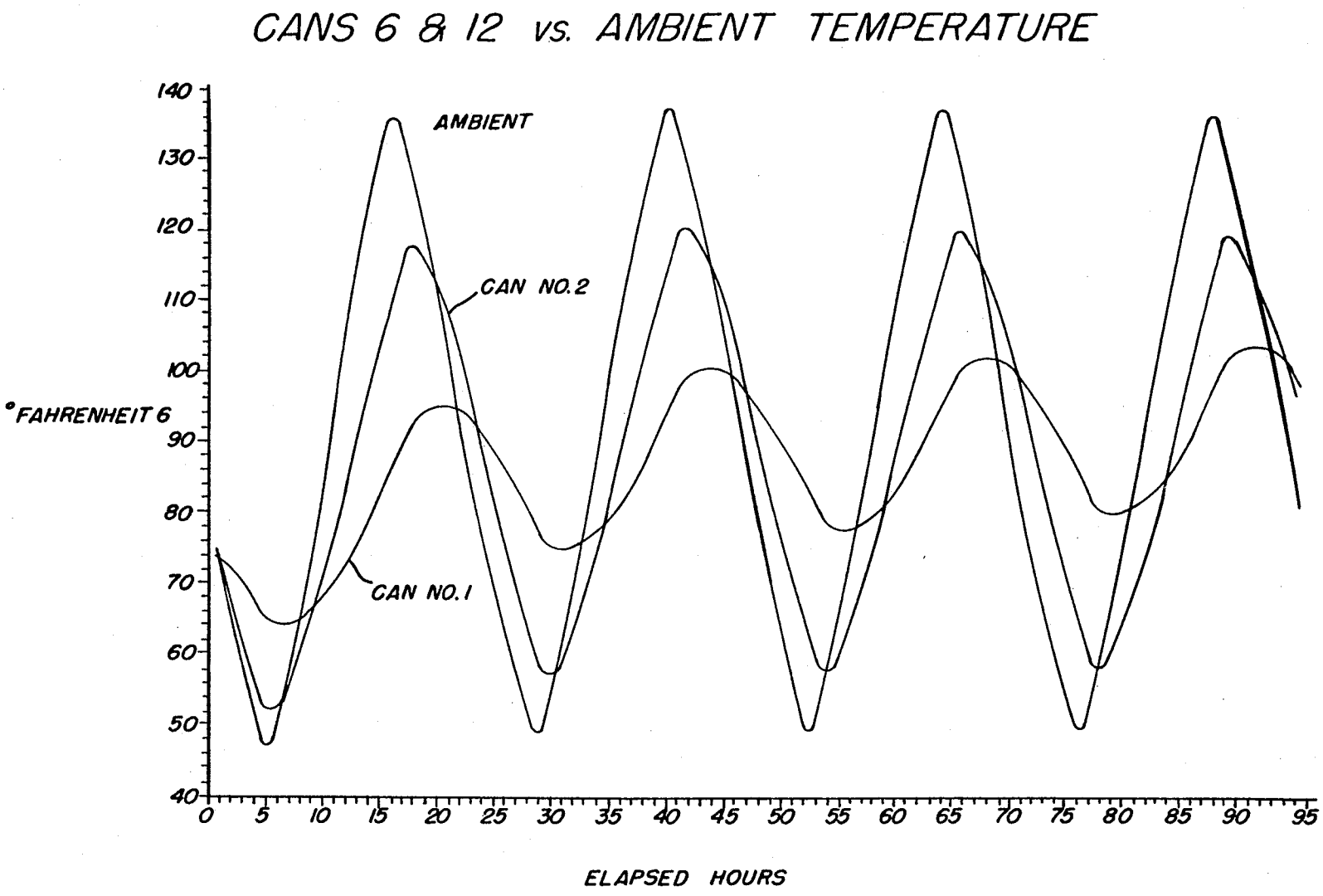
FIG. 12 is a graphic representation of variations in ambient temperature over a continuous period of time and which shows the variations in temperature of two cans located in identical positions in pallet stacks of displayed items such as soft drinks, the curve for can 1 showing the moderating effect of the enclosing structure formed according to this invention as against the wider variation in temperature of can 2 achieved by a pallet stack disposed outside an enclosing structure.

While the enclosure formed according to this invention is intended to protect against dust, dirt and other undesirable environmental factors, one of its principal purposes is to prevent excessive temperatures in an outdoor display for consumable items such for example as soft drinks. In FIG. 12, the ambient temperature is represented by a curve for an elapsed period of time of 95 hours. Against this ambient temperature curve two other curves are shown, one representing a can number 1 and the other representing can number 2. Identical pallet stacks of cans of soft drinks were formed and can number 1 was placed at a certain position in its associated stack within an enclosure formed according to this invention. Can number 2 was placed in an identical position to that of can number 1 in its associated pallet stack which was not protected by an enclosure such as that formed according to this invention. From FIG. 12 it is apparent that the temperature of can number 1 was moderated to a temperature level substantially below that of can number 2. Of course this fact is due to the protection afforded by the enclosure formed according to this invention. Experimental data accumulated in connection with can number 2 showed a substantial bulge in its ends indicating that unacceptable pressure had been developed within can 2. This factor is very significant in view of the fact that diet soft drinks for example utilize aspertane which is a substitute sweetener for sugar but which at elevated temperatures causes a bitter taste. Thus if temperature of a diet soft drink beverage exceeds acceptable levels, the product is useless because of its bitter taste.

Figure 13:
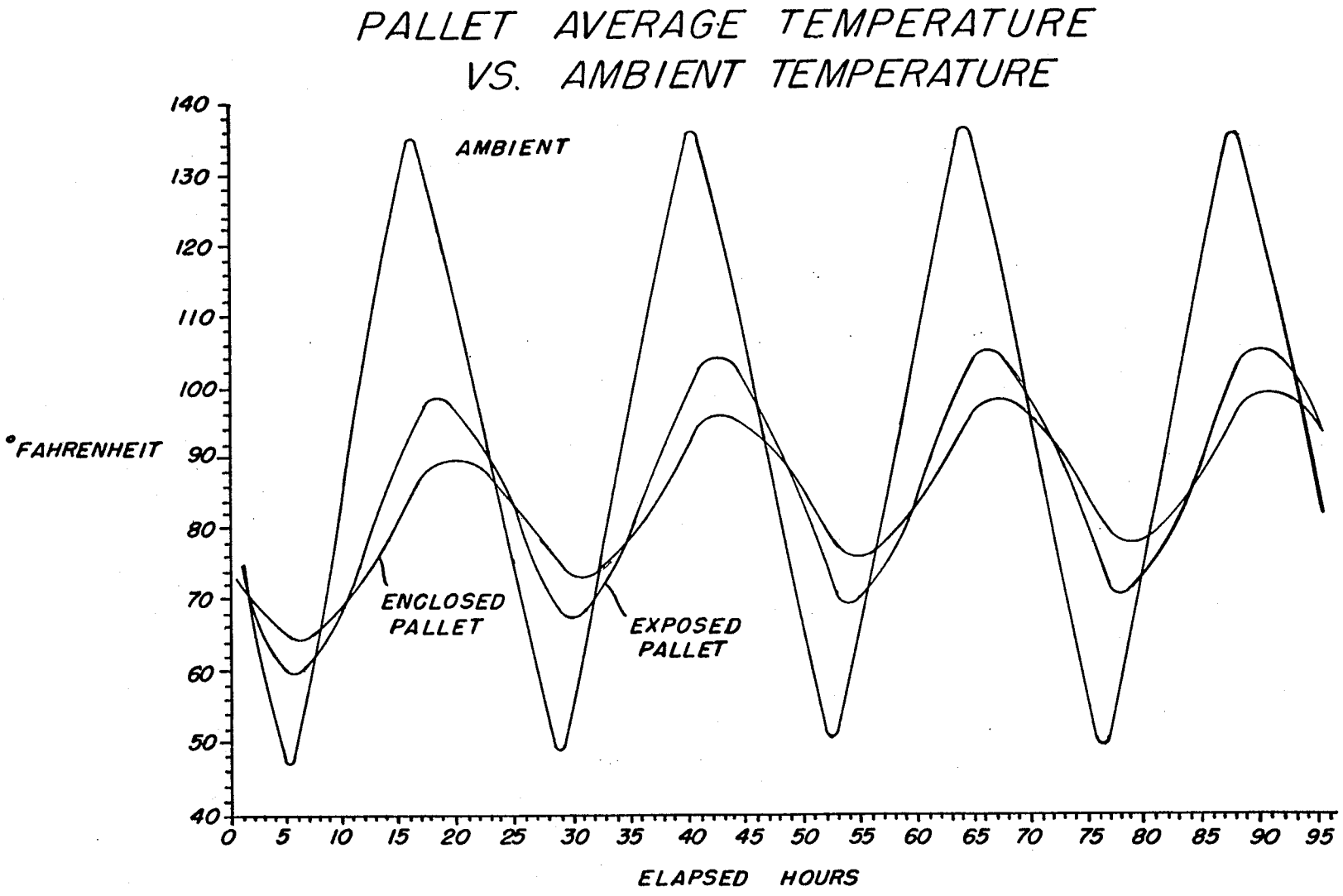
FIG. 13 is a graph similar to FIG. 12 which like FIG. 12 shows ambient temperature variation over a ninety five hour period plotted against average temperatures of several displayed items located at different but corresponding parts of two pallet stacks, one pallet of items being disposed in an enclosure according to the invention and the other of which was not enclosed in a protective enclosing structure.

FIG. 13 is in general similar to FIG. 12. In FIG. 13, ambient temperature is plotted over an elapsed period of ninety-five hours as in the case of FIG. 12. Instead of the temperature determined by sensors for a single can as is the case with FIG. 12, one curve in FIG. 13 identified as "ENCLOSED PALLET" represents an average temperature of some six cans located at different positions in a pallet stack whereas the "EXPOSED PALLET" curve represents the average temperature of six cans disposed in a pallet identical to that of the enclosed pallet but without utilizing the enclosure formed according to this invention. Analysis has shown that consistent results similar to those represented by FIG. 13 show a temperature of approximately 10 degrees Fahrenheit lower for enclosed pallets protected according to this invention as distinguished from those in pallets which are not protected. This difference in temperature has proved to maintain diet soft drinks which include aspertane in a condition which is not bitter and which is acceptable from the standpoint of taste.

In addition to cooling the displayed items by the flow of atmospheric air, it may be desirable to inject special cooling means. For example, infusion of carbon dioxide in gaseous form, cool water vapor or other temperature lowering media may be employed to augment cooling action.

An enclosure formed according to this invention is a durable, light weight inexpensive, device which is easy to install and which protects displayed items against dust, sand dirt and moisture and which extends shelf life of displayed items by virtue of its capacity to moderate temperatures and which avoids the development of bitter taste in products which incorporate aspertane or other temperature sensitive components.

We claim:

1. A product display enclosure comprising front, back and side walls interconnected along their side edges and having a top cover joined along its edges to the top edges of said front, back, and side walls to form a box-like structure adapted to overlie and surround a stack of procuct items so as to afford protection of such items against undesirable environmental conditions including dust, dirt, mositure, sunlight, and temperature variations, at least one of said walls being constructed to afford a view and ready access to such product items and side and back walls and said cover being formed of lightweight, corrugated, radiation reflecting material.

2. A product display enclosure comprising front, back and side walls interconnected along their side edges and having a top cover joined along its edges to the top edges of said front, back, and side walls to form a box-like structure adapted to overlie and surround a stack of product items so as to afford protection of such items against undesirable environmental conditions including dust, dirt, moisture, sunlight, and temperature variations, at least one of said walls being constructed to afford a view and ready access to such product items, said cover being tilted to shed precipitation, a plurality of vents are formed in each of said side walls, at least one of said vents being disposed near the upper edge of the associated side wall and adjacent the upper part of said cover so as to facilitate the discharge of heated air from the interior of the enclosure, and a closure panel hingedly mounted along an edge of each of said vents.

3. A product display enclosure comprising front, back and side walls interconnected along their side edges and having a top cover joined along its edges to the top edges of said front, back, and side walls to form a box-like structure adapted to overlie and surround a stack of product items so as to afford protection of such items against undesirable environmental conditions including dust, dirt, moisture, sunlight, and temperature variations, at least one of said walls being constructed to afford a view and ready access to such product items, said back wall being constructed and arranged so that a substantial open area is provided beneath the lower edge thereof, and a plurality of vents formed in said back wall near the upper portion thereof.

4. A product display enclosure comprising front, back and side walls interconnected along their side edges and having a top cover joined along its edges to the top edges of said front, back, and side walls to form a box-like structure adapted to overlie and surround a stack of product items so as to afford protection of such items against undesirable environmental conditions including dust, dirt, moistrure, sunlight, and temperature variations, at least one of said walls being constructed to afford a view and ready access to such product items, the front edges of said side walls being folded back on to the associated side walls for reinforcement and a double face tape interposed between said folded back and front edges of said side walls and the adjacent parts of said side walls.

5. A product display enclosure comprising front, back and side walls interconnected along their side edges and having a top cover joined along its edges to the top edges of said front, back, and side walls to form a box-like structure adapted to overlie and surround a stack of product items so as to afford protection of such items against undesirable environmental conditions including dust, dirt, moisture, sunlight, and temperature variations, at least one of said walls including manually movable transparent closure means to afford a view and ready access to such product items, and vent formed in said side and back walls, the total area of all of said vents being between 2 percent and 8 percent of the total surface area of the walls and cover excluding the area of said manually movable transparent closure means.

* * * * *